US006259088B1

(12) United States Patent
Antesberger

(10) Patent No.: US 6,259,088 B1
(45) Date of Patent: Jul. 10, 2001

(54) IMAGE INTENSIFIER TUBE WITH CURVED COMPONENTS

(75) Inventor: A. Wayne Antesberger, Woodbridge, VA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/339,287

(22) Filed: Jun. 24, 1999

(51) Int. Cl.[7] ..... H01J 31/50
(52) U.S. Cl. ..... 250/214 VT; 313/103 CM
(58) Field of Search ..... 250/214 VT, 207; 313/103 R, 103 CM, 105 CM, 524, 525, 527, 528, 532

(56) References Cited

U.S. PATENT DOCUMENTS 3,989,971 * 11/1976 Santilli et al. ..... 313/524
6,189,090 * 3/2001 Iosue ..... 250/214 VT

* cited by examiner

*Primary Examiner*—John R. Lee
*Assistant Examiner*—Kevin Pyo
(74) *Attorney, Agent, or Firm*—Milton W. Lee; John E. Holford; Alain L. Bashore

(57) ABSTRACT

A modified night vision image intensifier device providing an enhanced viewable scene with greater than 60 degrees FOV utilizing a modified tube assembly including: a curved photocathode, curved micochannel plate and phosphor screen.

6 Claims, 2 Drawing Sheets

IMAGE INTENSIFIER TUBE WITH CURVED COMPONENTS

BACKGROUND OF THE INVENTION

1. Field of the Invention

The present invention generally relates image intensifier tubes and more specifically, to curved image intensifier tube components.

2. Description of Prior Art

The main component of the production model image intensifier device utilizes the intensifer tube which includes a photocathode, microchannel plate (MCP), and phosphor screen all of which are flat in cross section along the image path. With an overwhelming desire to achieve increased Field of View (FOV) for devices of this type, the optics designs become increasingly difficult, complicated, and heavy for the image intensifier device.

The maximum FOV for a typical currently fielded US military image intensifer system is 40 degrees, with full moon resolution of 0.8 cyc/mr. The next generation of imagers are anticipated to have a 60 degree FOV and full moon resolution of 1.2 cyc/mr. Optics for supporting a 60 degree FOV, with adequate exit pupil, become large (heavy), complicated, and expensive. The soldier, both airborne and dismounted, desire a Field of View more closely approximating natural vision which is about 160 degrees.

In an effort to increase the Field of View for an image intensifier system, certain optics in the system have been fabricated as curved. Coupling the curved optical space created by the objective lens to a flat intensifier faceplate has proven challenging and inefficient. Eyepiece assemblies are currently designed for a curved image plane; the prior art flat phosphor screen is coupled to a Fiber Optic Twist (FOT) with a curved surface to invert the image for proper viewing orientation and simplify the eyepiece design.

While the prior art has reported using image intensifer tube components none have established a basis for specific components that are dedicated to the task of resolving the particular problem at hand. What is needed in this instance is a modified night vision image intensifier device providing an enhanced viewable scene with greater than 60 degrees FOV.

SUMMARY OF THE INVENTION

It is therefore one object of the invention to provide a modified night vision image intensifier device providing an enhanced viewable scene with greater than 60 degrees FOV.

According to the invention, there is disclosed a modified night vision image intensifier device providing an enhanced viewable scene with greater than 60 degrees FOV. A tube assembly with input and output ends along the optical axis, receives focused incoming light from an objective lens. A Curved photocathode receives the focused incoming light along the optical axis onto its surface and emits electrons proportional to the focused incoming light. A curved micro channel plate accepts electrons as input on a spatial axis and emits multiplied electrons as output proportional to said input on the spatial axis. The emitted electrons are accepted by a curved phosphor screen and there is output a proportional corresponding optical emission. The optical emission as intensified light accepted into the eyepieces for focusing as a viewable enhanced scene with a greater than 60 degree field of view.

Electrostatic focusing elements may optionally be utilized to accommodate curved surfaces of the different tube components and the intended complex paths of the electrons.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
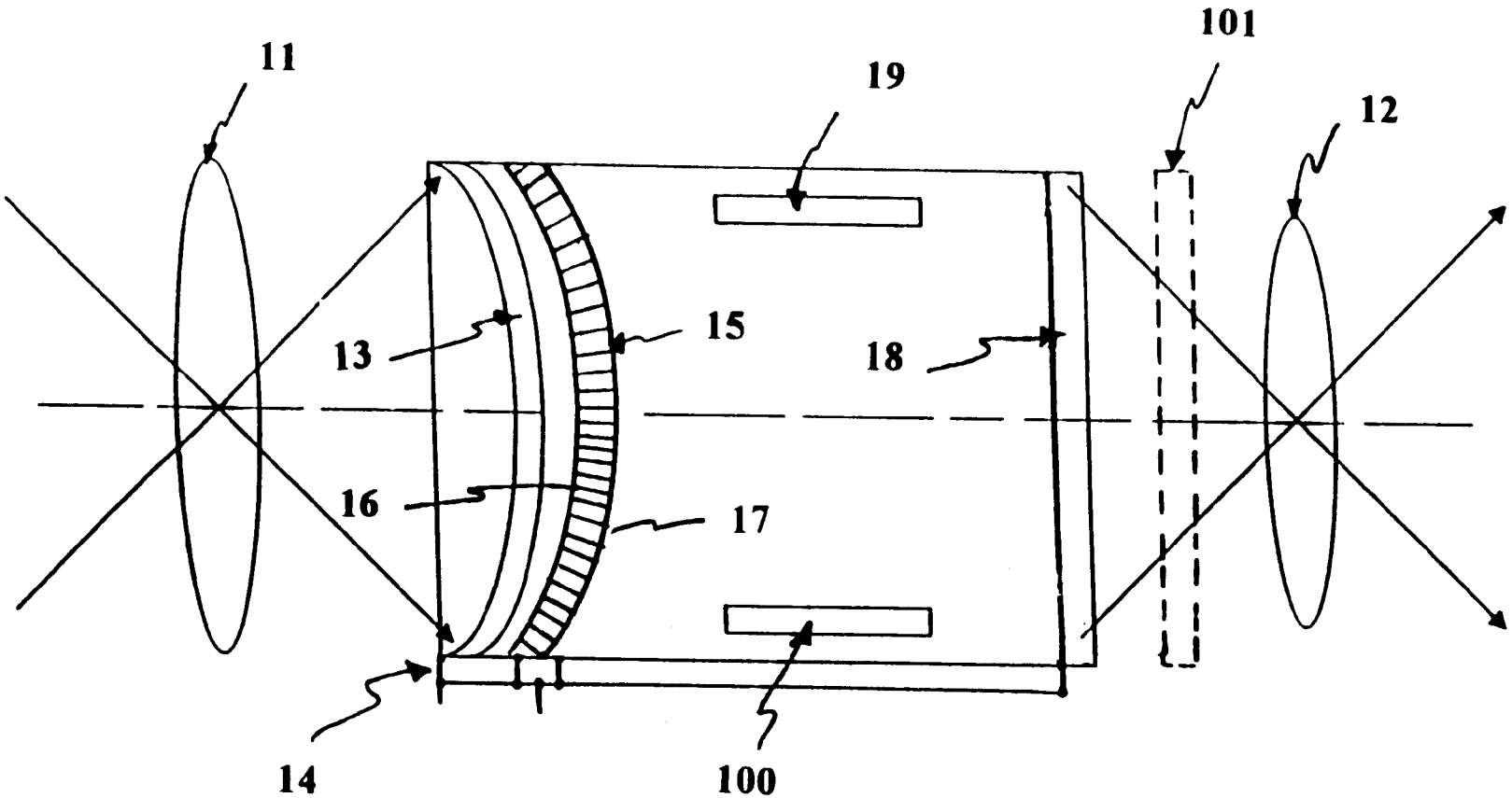
FIG. 1 is an axial section of an intensifer tube of the present invention.

Referring now to the drawings, and more particularly to FIG. 1, there is shown an axial section of an intensifier tube assembly of the present invention. Tube assembly 10, with input and output ends along the optical axis, receives focused incoming light from objective lens assembly 11 at said input end and providing at said output end an intensified light to eyepiece 12. Curved photocathode 13 receives the focused incoming light along the optical axis onto its surface and emits electrons proportional to the focused incoming light. Connection 14 electrically connects photocathode 13 to an input and output electrode forming an assembly electrode.

Curved micro channel plate 15 having opposite faces is shown in FIG. 1. Curved micro channel plate 15 accepts electrons as input on a spatial axis and emits multiplied electrons as output proportional to said input on the spatial axis. The faces include conductive faces 16 and 17 which act as input electrode and output electrode respectably. Phosphor screen 18 accepts the multiplied electrons on the spatial axis and there is output a proportional corresponding optical emission. The photocathode can be either a vacuum vapor deposition process onto a glass substrate, or the growing of a crystal on a glass substrate. Phosphor screen 18 may be curved to achieve maximum electron coverage. The optical emission is intensified light accepted into eyepiece 12 for focusing as a viewable enhanced scene with a greater than 60 degree field of view.

Electrostatic focusing elements 19 and 100 may optionally be utilized to accommodate curved surfaces of the different tube components and the intended complex paths of the electrons. Electrostatic focusing is the management of electron paths and beams with magnetic fields. Anode and cathode surfaces are implanted in the device and the associated magnetic fields would focus, amplify, and/or control the electron paths, much the same as lenses control light.

Figure 2:
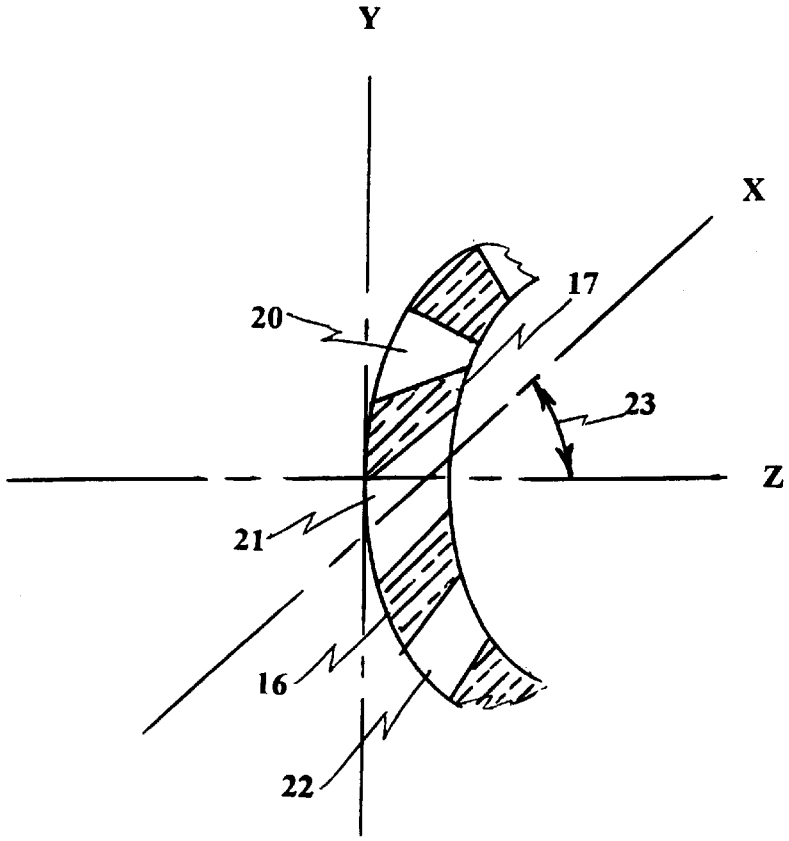
FIG. 2 is an enlarged fragmentary section of the curved MCP utilized in the intensifer tube of FIG. 1.

FIG. 2 is an enlarged fragmentary section of the curved MCP utilized in the intensifer tube of FIG. 1. A MCP is a collection of microscopic glass tubes sliced into wafers, then "metallized" for electrical conductivity and "end spoiled" to limit rogue electrons. End spoiling is the coating of each side of the MCP with an insulator in an attempt to funnel electrons down their proper channels. A small bias angle of 6 degrees may be introduced into the MCP channels when the wafers are cut from the boule by slicing the wafers at a slight angle. The flat MCP would be placed on a curved mandrel and the temperature elevated until it conforms to the shape of the mandrel. Alternatively, straight cut glass wafers could be elevated to a plastic temperature for glass, and then skewed between two plates to create a bias angle of the glass channels. As an additional step, when the MCP is still fluid/flexible, it could be formed into a curve between two shaped mandrels before cooling. All "end spoiling" manufacturing processes could then be performed. FIG. 2 shows an enlarged fragmentary section of the curved MCP having a plurality of passageways, such as passageways 20, 21 and 22 opening out to said opposite faces 16 and 17. The passageways will have an average bias angle 23 shown in FIG. 2. If a bias angle of 6 degrees is utilized in the method of making the curved MCP, then there will be a greater than 6 degrees average bias angle in the final curved MCP produced. All passageways are frustum shaped which with the overall curved shape of micro channel plate 15, and other curved image intensifier components, allow for the increase in FOV without distortion resultant in operation of the image intensifier.

Figure 3:
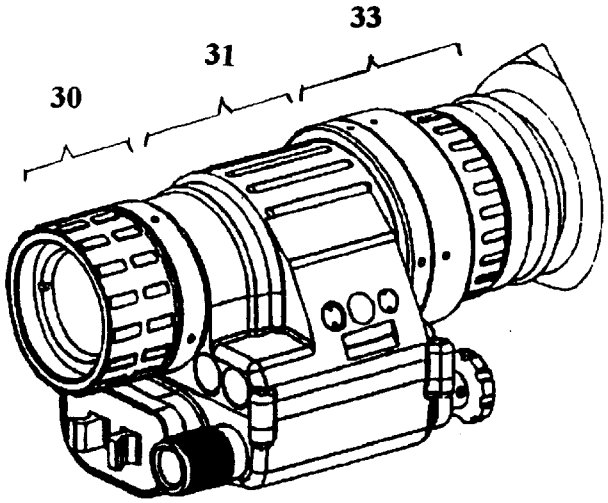
FIG. 3 is an image intensifier utilizing the present invention.

FIG. 3 is a monocular image intensifier device utilizing the present invention. Objective lens assembly 30 receives incoming light which is focused onto tube assembly 31 of the present invention. The focused incoming light is then intensified and the FOV expanded to greater than 60 degrees. Output light from tube assembly 31 is received within body 32 of the image intensifier which collimates the output light and split by an internal prism to two eyepieces in eyepiece assembly 33. The curved components of the present invention reduces the complexity of the supporting optical design. Fiber optic twist (FOT) 101, shown in phantom in FIG. 1, may be eliminated within tube assembly 31 of FIG. 3. If tube geometry dictated, FOT 101 could have curved surfaces on each end surface. A curved focal plane would allow more design flexibility with fewer elements, reducing complexity and weight, while making it easier to control distortion and astigmatism.

While this invention has been described in terms of preferred embodiment consisting of the modified night vision image intensifier device, those skilled in the art will recognize that the invention can be practiced with modification within the spirit and scope of the appended claims.

Having thus described my invention, what I claim as new and desire to secure by Letters Patent is as follows:

1. A modified night vision image intensifier device for providing an enhanced viewable scene with a greater than 60 degree field of view, wherein the device includes an objective lens assembly for focusing incoming light, which focused light is then input to a tube assembly that intensifies the focused light as intensified light, after which the intensified light is collimated and then accepted into one or more eyepieces for focusing as a viewable enhanced scene, the improvement comprising:

a modified tube assembly, with input and output ends along the optical axis, said tube assembly receiving focused incoming light at said input end and providing at said output end an intensified light, said tube assembly further including, a curved photocathode for receiving said focused incoming light along the optical axis onto a curved photocathode surface and emitting from said curved photocathode surface as electrons, proportional to said focused incoming light, said photocathode electrically connected to an input and output electrode forming an assembly electrode;

a curved micro channel plate having opposite faces with a conductive surface on each face, after said photocathode on said optical axis, for accepting said electrons as input on a spatial axis and emitting multiplied electrons as output proportional to said input on said spatial axis, said conductive faces include a conductive face on said plate facing said photocathode as said input electrode, and a conductive face on said plate facing a curved phosphor screen as an output electrode, said curved micro channel plate further including a plurality of passageways opening out to said opposite faces, further wherein each passageway of said plurality of passageways is frustum shaped;

a phosphor screen for accepting said multiplied electrons on said spatial axis, said phosphor screen electrically connected to said input and output electrodes forming an assembly anode, whereby intensified light is output on said optical axis from said tube assembly after which the intensified light is collimated and then accepted into one or more eyepieces for focusing as a viewable enhanced scene with a greater than 60 degree field of view.

2. The modified night vision image intensifier device of claim 1 wherein said each passageway of said plurality of passageways has an average bias angle of less than 6 degrees.

3. The modified night vision image intensifier device of claim 1 wherein said each passageway of said plurality of passageways has an average bias angle of greater than 6 degrees.

4. The modified night vision image intensifier device of claim 1 wherein the improvement further includes a modified fiber optic twist positioned after said modified tube assembly for image inverting, said modified fiber optic twist further including curved end surfaces.

5. The modified night vision image intensifier device of claim 1 wherein said modified tube assembly further includes at least one electrostatic focusing element positioned between said curved micro channel plate and said phosphor screen, said electrostatic focusing element for modification of electron paths with magnetic field emission.

6. The modified night vision image intensifier device of claim 1 wherein said phosphor screen is curved shaped in cross-section.

* * * * *